US006679147B1

(12) United States Patent
Chaulklin

(10) Patent No.: US 6,679,147 B1
(45) Date of Patent: Jan. 20, 2004

(54) INSERTABLE PUNCH LOCK

(76) Inventor: Michael J. Chaulklin, 4532 Countrywood Ct., SE., Kentwood, MI (US) 49546

( * ) Notice: Subject to any disclaimer, the term of this patent is extended or adjusted under 35 U.S.C. 154(b) by 0 days.

(21) Appl. No.: 09/398,410

(22) Filed: Sep. 17, 1999

(51) Int. Cl.[7] ..... B26D 1/00; B26F 1/14

(52) U.S. Cl. ..... 83/698.91; 83/698.31; 83/684; 83/691; 83/954; 83/698.11

(58) Field of Search ..... 83/698.91, 698.31, 83/685, 571, 698.41, 698.11, 687, 686, 698.71, 549, 618

(56) References Cited

U.S. PATENT DOCUMENTS

| | | | | | |
|---|---|---|---|---|---|
| 239,958 | A | * | 4/1881 | Inman | 403/257 |
| 2,217,560 | A | * | 10/1940 | Michon | 279/6 |
| 2,707,830 | A | * | 5/1955 | McColl | 30/336 |
| 3,106,122 | A | * | 10/1963 | Newcomb | 83/698.91 |
| 3,245,694 | A | * | 4/1966 | Parker | 83/698.91 |
| 3,548,700 | A | * | 12/1970 | Herzog | 83/698.91 |
| 3,563,124 | A | * | 2/1971 | Gargrave | 83/698 |
| 3,589,226 | A | * | 5/1971 | Shadowens, Jr. | 83/698 |
| 3,901,475 | A | | 8/1975 | Dreibelbis | |
| 3,932,904 | A | * | 1/1976 | Nilsson et al. | 279/145 |
| 3,934,591 | A | * | 1/1976 | Gleason | 606/132 |
| 4,096,776 | A | | 6/1978 | Laucke | |
| 4,174,648 | A | | 11/1979 | Wallis | |
| 4,218,794 | A | * | 8/1980 | Seidel et al. | 30/158 |
| 4,558,620 | A | * | 12/1985 | Wallis | 83/698 |
| 4,726,270 | A | * | 2/1988 | Lucas | 83/698 |
| 4,843,931 | A | | 7/1989 | Whistler | |
| 4,947,718 | A | | 8/1990 | Whistler | |
| 4,954,006 | A | | 9/1990 | Suzuki et al. | |
| 4,995,755 | A | | 2/1991 | Hyodo et al. | |
| 5,038,599 | A | | 8/1991 | Wellman | |
| 5,048,993 | A | | 9/1991 | Yoon | |
| 5,181,438 | A | | 1/1993 | Wellman | |
| 5,197,368 | A | | 3/1993 | Meyer et al. | |
| 5,284,069 | A | | 2/1994 | Wellman | |
| 5,301,580 | A | * | 4/1994 | Rosene et al. | 83/136 |
| 5,357,835 | A | | 10/1994 | Moellering | |
| 5,357,836 | A | * | 10/1994 | Stromberg et al. | 83/698.31 |
| 5,410,932 | A | | 5/1995 | Moellering | |
| 5,562,357 | A | | 10/1996 | Sandell | |
| 5,651,647 | A | * | 7/1997 | Ray | 279/14 |
| 5,878,642 | A | * | 3/1999 | Roseliep | 83/690 |
| 5,881,625 | A | | 3/1999 | Wellman | |
| 6,158,928 | A | * | 12/2000 | Hecht | 407/102 |
| 6,182,545 | B1 | * | 2/2001 | Janek, Jr. | 83/698.91 |

OTHER PUBLICATIONS

Exhibit A, Exhibit A is a three page excerpt from a brochure from Porter Precision Products, Co. describing Bol–Lok Retainers that was published prior to the invention of this application.

Exhibit B, Exhibit B is a five page excerpt from a describing several types of punch retainers that was published prior to the invention of this application.

(List continued on next page.)

*Primary Examiner*—Boyer D. Ashley
(74) *Attorney, Agent, or Firm*—Van Dyke, Gardner, Linn & Burkhart, LLP

(57) ABSTRACT

A punch retainer system includes one or more punch retainers that are selectively insertable into a retainer block. The punch retainers are dimensioned such that they can be positioned closely together and thereby allow punches to be arranged in a closely positioned arrangement. The punch retainers are insertable into a retainer block which includes recesses dimensioned to receive the punch retainers. The recesses are custom-cut in the desired arrangement by the tool and die shop. After insertion of the punch retainers into the retainer block, the punch retainer and retainer block assembly is secured to a die shoe. The punch retainers may include a releasable lock for selectively securing the punches in the punch retainers.

20 Claims, 4 Drawing Sheets

OTHER PUBLICATIONS

Exhibit C, Exhibit C is a five pate excerpt from a brochure from Dayton corporation describing several punch retainers that was published prior to the invention of this application.

Exhibit D, Exhibit D is a two page excerpt from a brochure from Lane Punch Corporation describing several punch retainers that was published prior to the invention of this application.

Exhibit E, Exhibit E is a five page excerpt from a Dayton Corporation brochure describing several punch retainers that was published prior to the invention of this application.

Exhibit F, Exhibit F is a three page excerpt from a 1994/1995 JP&T catalog describing several punch retainers.

* cited by examiner

INSERTABLE PUNCH LOCK

BACKGROUND OF THE INVENTION

This invention relates generally to tool and die assemblies, and more particularly to punch retainers for use in a punch and die assembly.

When sheet metal or other types of products are manufactured, it is often necessary that the products include one or more apertures. Typically a die with a punch secured thereto is used to create these apertures in the product to be manufactured. An example of such a punch 1000 is depicted in FIG. 8. Punch 1000 includes a piercing end 1002, which contacts and pierces the product under manufacture. The punch 1000 is secured to a punch retainer 1004, which is in turn secured to a die shoe 1006. Between the punch retainer 1004 and die shoe 1006, a backing plate 1008 is typically secured. As the entire assembly moves downward, punch 1000 contacts the product and pierces it. Punch 1000 can take on a variety of different dimensions depending upon the desired dimensions of the aperture to be created.

Punch retainers 1004 come in a variety of different shapes. As illustrated in FIGS. 9–11, there are three standard types of prior art punch retainers. FIG. 9 depicts a generally triangular shaped punch retainer, which is often referred to as a true retainer. FIG. 10 depicts a square retainer and FIG. 10 depicts an end retainer. Each of the retainers includes a punch aperture 1010 into which a punch 1000 is inserted. As shown in FIGS. 9–11, each of the punch retainers also includes a pair of alignment holes 1012 which receive dowel pins and are used for properly aligning the punch retainer on the die shoe 1006. Each of the punch retainers also includes a pair of fastener holes 1014 through which a fastener, such as a screw or bolt is inserted in order to secure the punch retainer to the die shoe 1006.

The prior art punch retainers depicted in FIGS. 9–11 suffer from the disadvantage that they cannot be closely spaced together. In other words, if the product being manufactured requires a number of closely spaced holes that are to be created by a punch, the punch retainers shown in these figures cannot be used. For example, as shown in FIG. 12, punch aperture 1010 is located a distance A from the front end of the punch retainer. Punch aperture 1010 is also located a distance B from the side of the punch retainer. A pair of punch retainers like the one of FIG. 12 can therefore not be used to create a hole pattern in which the holes are spaced closer than either the distance 2A or 2B. This limitation on the closeness of the holes that can be punched using prior art punch retainers has been difficult to overcome.

In order to create closely spaced together holes in the past, it has been necessary for most machine shops to special order a custom-made punch retainer that will accommodate the desired hole pattern. While some machine shops have the necessary tools to make such a custom-made part, it is beyond the ability of the majority of machine shops. Consequently, those machine shops which have had to order the custom-made part have often had to wait up to a week or more for the part to be created and delivered. The specially ordered part has also typically cost significantly more than the standard punch retainers depicted in FIGS. 9–12. The creation of closely spaced punched holes in the past has therefore undesirably required the expenditure of additional time and money in order for the appropriate parts to be custom-made.

The only other option in the past for accommodating closely spaced hole patterns was to use a retainer with a headed punch. Headed punch retainers, however, do not have ball locks, or other types of locks, with release mechanisms. Headed punch retainers therefore suffer from the disadvantage that the headed punch cannot be removed from the retainer without removing the entire retainer from the die shoe. This makes the sharpening of the punch, or other types of maintenance, extremely labor intensive. The need can therefore be seen for a punch retainer which allows closely spaced hole patterns to be created, and at the same time is both inexpensive and easy to create and easy to maintain.

SUMMARY OF THE INVENTION

Accordingly, the present invention provides a punch retainer which is both easy to create and maintain. The punch retainer according to one aspect of the present invention includes a body having a top and bottom face. An aperture is defined in the body for receiving the punch. The aperture extends from the top face to the bottom face of the body. The punch retainer further includes a peripheral surface on the body that is tapered inwardly from the top face to the bottom face of the body.

A punch retainer according to another aspect of the invention includes a body having a top and bottom face. The body includes no fastener holes for receiving a fastener that is used to secure the body to a die shoe. The body further includes an aperture for receiving a punch, along with a lock for selectively retaining the punch in the aperture.

According to still another aspect of the invention, a punch retainer system includes at least one insertable punch retainer having a body that defines an aperture for receiving a punch. The system further includes a retainer block that has at least one recess configured to snugly receive the insertable punch retainer. The retainer block further includes at least one hole for receiving a fastener that is used to secure the retainer block to a die shoe.

In yet another aspect of the invention, a method for securing a punch to a die includes the steps of providing an insertable punch retainer having an aperture for receiving a punch. A retainer block is also provided. A recess is cut in the retainer block such that the recess has a shape that is dimensioned to receive the insertable punch retainer. The insertable punch retainer is then inserted into the recess and the retainer block is fastened to a die shoe.

The punch retainer of the present invention provides an easy system for closely arranging punches on a die. The punch retainers themselves are dimensioned sufficiently small such that they can be positioned as close together as possible. The punch retainers are inserted into a retainer block that is cut to receive the insertable punch retainers at their desired locations. The cutting of the retainer block can be accomplished in a variety of ways, but is easily accomplished through the use of a wire electric discharge machining (EDM) tool. These wire EDMs are typically a standard tool in any tool and die shop. The punch retainer system of the present invention therefore overcomes the necessity of having to order custom-made parts from a separate supplier. Moreover, the punch retainer system of the present invention still provides a punch retaining system in which the punches can be easily removed for maintenance purposes. These and other benefits, results, and objects of the present invention will be apparent to one skilled in the art in light of the following specification when read in conjunction with the accompanying drawings.

DETAILED DESCRIPTION OF THE PREFERRED EMBODIMENTS

Figure 1:
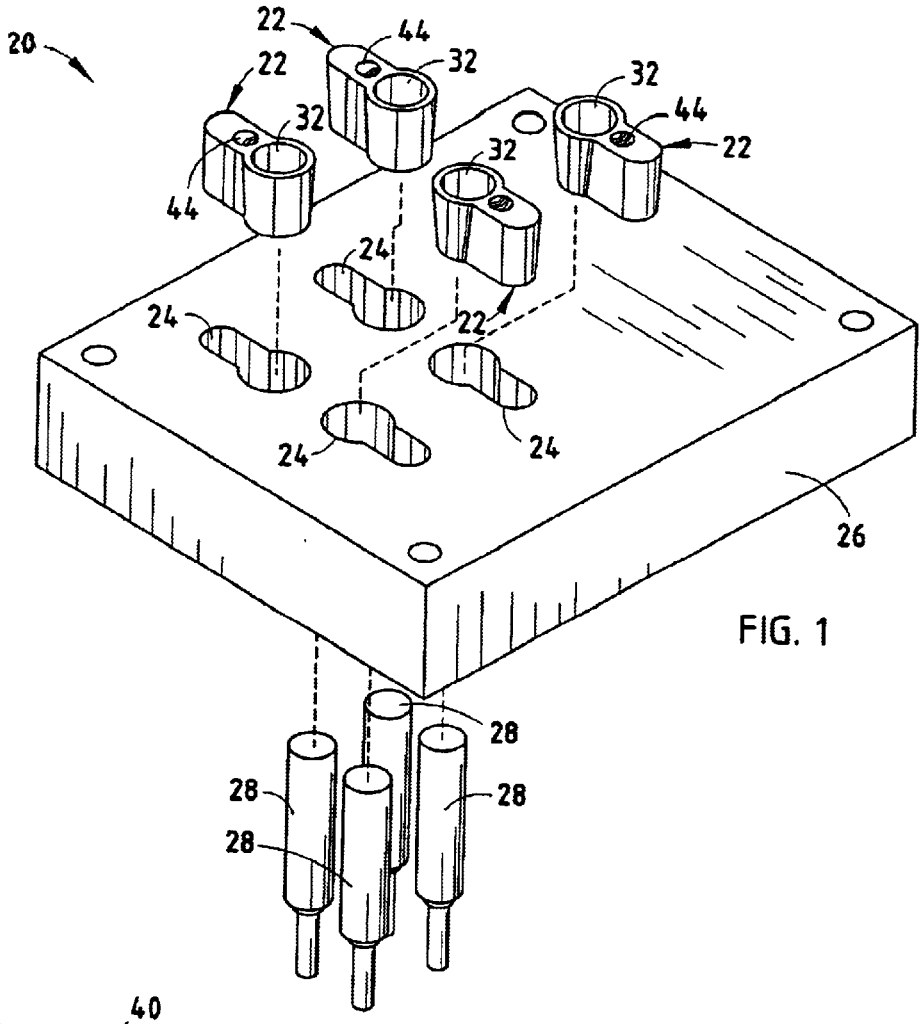
FIG. 1 is a perspective view of a punch retainer system according to one embodiment of the present invention.

The present invention will now described with reference to the accompanying drawings wherein like reference numerals correspond to like elements in the several drawings. A punch retainer system 20 according to one aspect of the present invention is depicted in FIG. 1. Punch retainer system 20 includes a plurality of punch retainers 22 that are insertable into corresponding recesses 24 defined in a retainer block 26. A conventional punch 28 is insertable into each punch retainer 22. In this embodiment, punch retainers 22 include a peripheral surface 30 that is tapered. The recesses 24 have a corresponding taper that prevents punch retainers 22 from sliding completely through recesses 24. After punch retainers 22 are inserted in recesses 24, retainer block 26 is secured to a shoe die (not shown in FIG. 1). Punches 28 can then be inserted into apertures 32 and punch retainers 22. Punch retainers 22 each include a lock that selectively secures the punches 28 in the apertures 32, as described in more detail herein. In operation, a tool and die shop would typically order a number of punch retainers 22. The tool and die shop would then cut the recesses 24 in retainer block 26 according to a desired hole pattern. The cutting of retainer block 26 can easily be accomplished through the use of a wire EDM machine, which is a standard tool in virtually all tool and die shops. Therefore, when a tool and shop needed to create a punch pattern that heretofore required a custom-made punch retainer, the tool and die shop can simply custom-cut retainer block 26 and use punch retainers 22 in accordance with the present invention. This avoids the problems of the prior art where the custom-made part required special tools and took an undesirable amount of time and cost to obtain.

Figure 2:
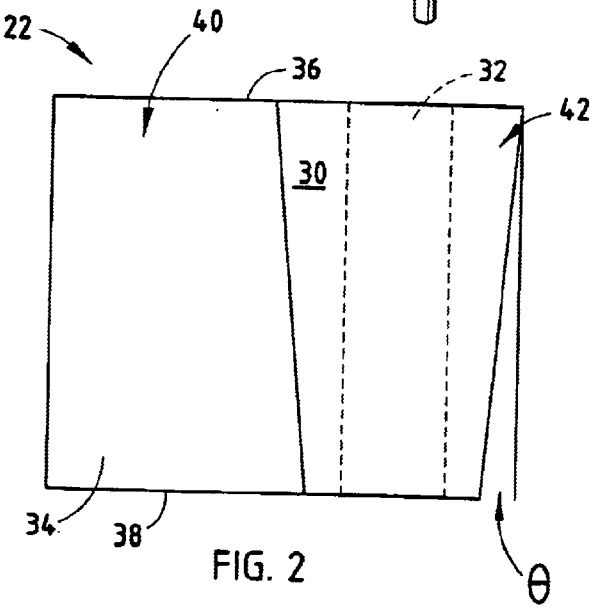
FIG. 2 is a side, elevational view of a punch retainer according to one embodiment of the present invention.

Punch retainer 22 includes a body 34 having a top face 36 and bottom face 38 (FIGS. 1–4). Body 34 is divided into a lock-housing portion 40 and an aperture portion 42. Peripheral surface 30 surrounds both lock housing portion 40 and aperture portion 42. In the currently preferred embodiment, peripheral surface 30 is tapered inwardly from top face 36 to bottom face 38 around aperture portion 42 only. The portion of peripheral surface 30 surrounding lock-housing portion 40 is not tapered in this embodiment. It will, however, be understood that peripheral surface 30 could be completely tapered or any suitable fraction thereof could be tapered. The purpose of the taper is to provide a means for securing punch retainer 22 in retainer block 26. Retainer block 26 includes a surface that is tapered inwardly to correspond to the taper of peripheral surface 30. The tapered surfaces prevent punch retainer 22 from being removed out of the bottom of retainer block 26. A backing plate is secured over the top of retainer block 26 and thereby prevents punch retainers 22 from being removed from the top of retainer block 26. In the currently preferred embodiment, the degree of taper is relatively small. As shown in FIG. 2, the angle theta is preferably about 1°. While other degrees of taper can of course be used within the scope of the invention, increasing the angle of taper will cause a corresponding increase in the surface area of top face 36. An increased surface area of top face 36 will mean that the punch retainers 22 cannot be positioned quite as closely together as they would be with a smaller angle of taper. Therefore, it is desirable to have as small of an angle of taper as possible, that will still securely retain punch retainer 22 in retainer block 26.

Figure 3:
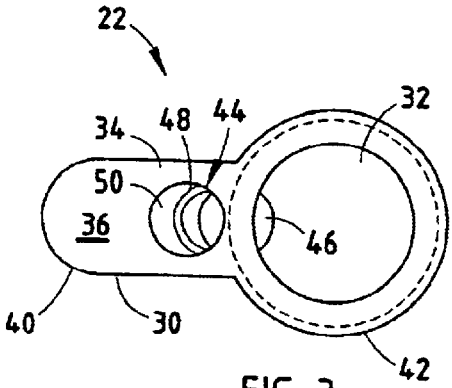
FIG. 3 is a plan view of the punch retainer of FIG. 2.
Figure 4:
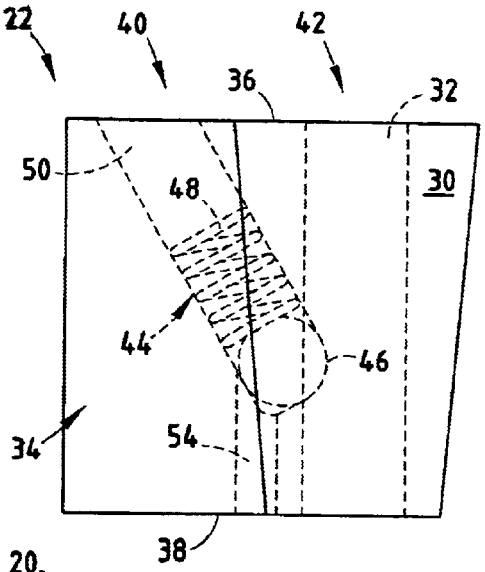
FIG. 4 is a side, elevational view of the punch retainer of FIG. 2, illustrating in phantom the location of a ball and spring lock.
Figure 5:
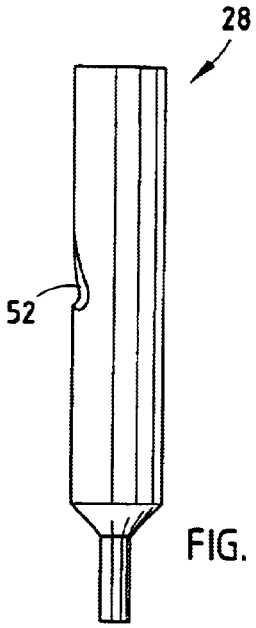
FIG. 5 is a side, elevational view of a punch.

Punch retainers 22 include a lock 44 that is used to selectively retain punch 28 in aperture 32 (FIGS. 3–4). While any type of lock 44 can be used within the scope of the invention, lock 44 is preferably a conventional ball and spring lock. As shown in FIG. 4, the ball and spring lock includes a ball 46 and spring 48 that is disposed in a channel 50. Spring 48 is secured in channel 50 in any conventional manner. Spring 48 biases ball 46 into aperture 32. When a punch 28 is inserted into aperture 32, it inserted from the bottom face 38 side of punch retainer 22. As such, punch 28 initially pushes ball 46 against spring 48 and up channel 50. The punch 28 includes a whistle-stop 52 (FIG. 5) which ball 46 seats against after punch 28 has been fully inserted. Punch 28 can thereafter not be removed from aperture 32 without moving ball 46 up channel 50. This is accomplished by a special instrument that is inserted through a release channel 54 and which causes ball 46 to move up channel 50. In this manner, punches 28 can be removed from punch retainers 22 without having to disassemble punch retainer system 20.

Figure 6:
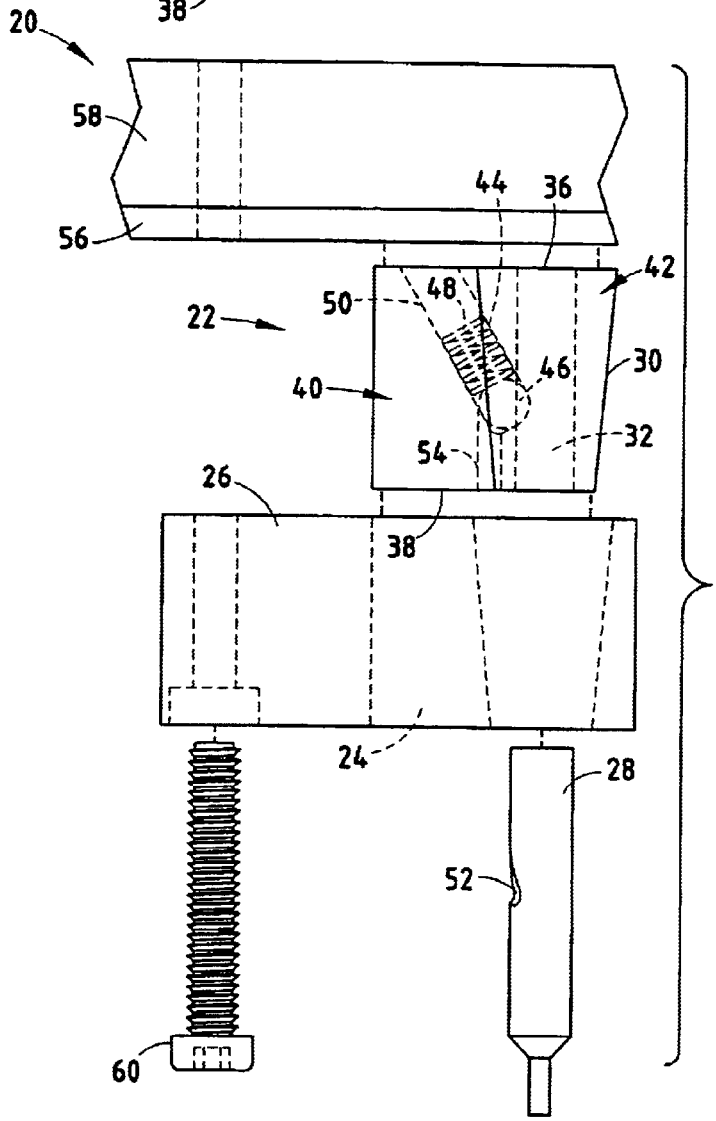
FIG. 6 is an exploded, side, elevational view of a punch retainer, retainer block, backing plate, and shoe die.
Figure 7:
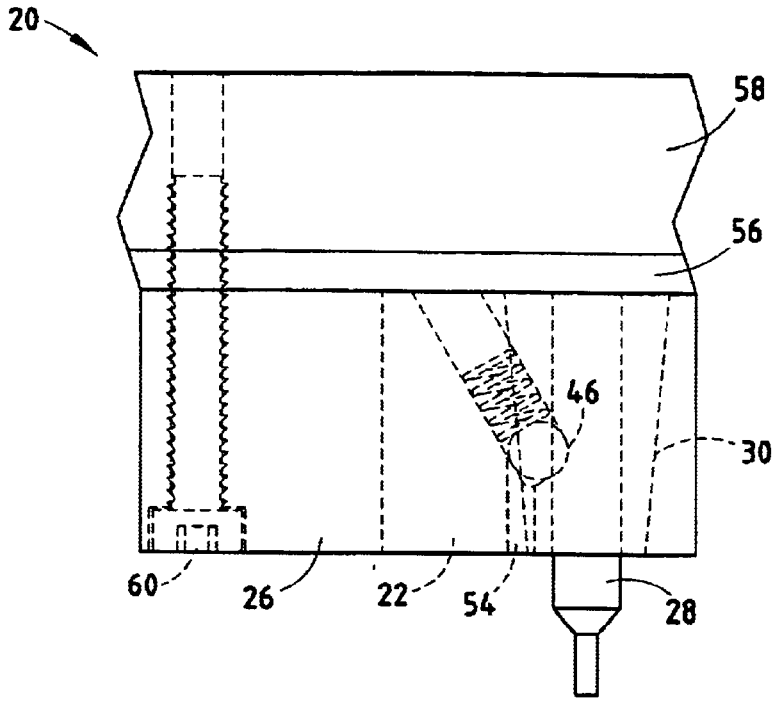
FIG. 7 is an assembled, side elevational view of the components of FIG. 6.
Figure 8:
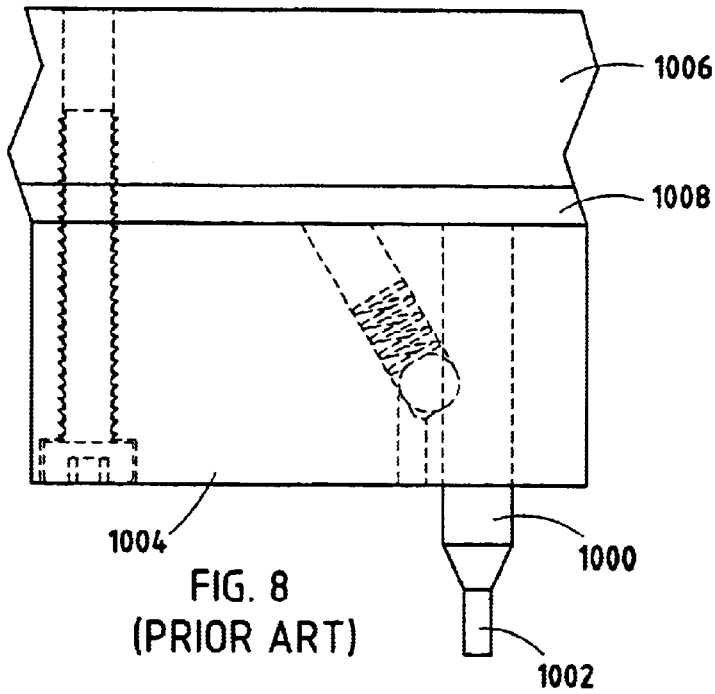
FIG. 8 (PRIOR ART)
FIG. 8 is a side, elevational view of a prior art punch retainer.
Figure 9:
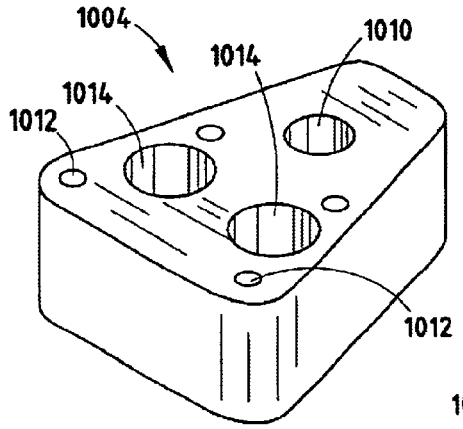
FIG. 9 (PRIOR ART)
FIG. 9 is a perspective view of a triangular prior art punch retainer.
Figure 10:
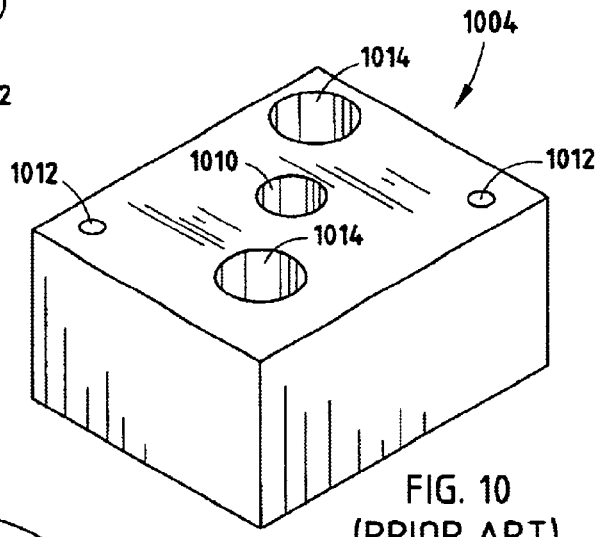
FIG. 10 (PRIOR ART)
FIG. 10 is a perspective view of a square, prior art punch retainer.
Figure 11:
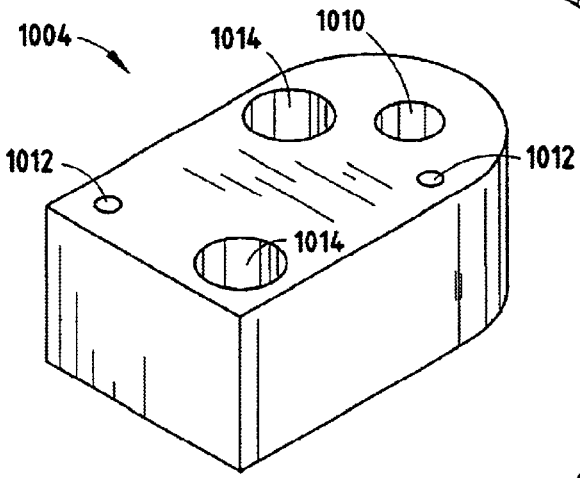
FIG. 11 (PRIOR ART)
FIG. 11 is a perspective view of an end, prior art punch retainer.
Figure 12:
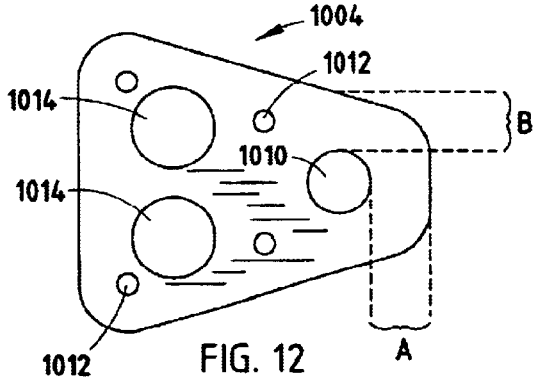
FIG. 12 (PRIOR ART)
FIG. 12 is a plan view of the prior art punch retainer of FIG. 9.

When punch retainer system 20 is desired to be used, the number of punch retainers 22 and the location of recesses 24 is first decided. Recesses 24 are then cut into retainer block 26 at the desired location. While any conventional cutting technique can be used, a wire EDM cut is especially suitable as most tool and die shops have wire EDMs as part of their equipment. The wire EDM provides a simple way of cutting the required shape and taper to accommodate punch retainers 22. After recesses 24 are cut in retainer block 26, the punch retainers 22 are inserted into the recesses as depicted in FIGS. 6–7. After insertion, the entire retainer block and punch retainers 22 are pressed up against a backing plate 56 adjacent a die shoe 58 backing plate 56 contacts top face 36 of punch retainer 22. Because of the tapering of punch retainers 22, it is prevented from sliding out of the bottom of recess 24. The assembly of retainer block 26 and punch retainers 22 is secured to backing plate 56 and die shoe 58 by way of a fastener 60 which may be a screw or bolt. Fastener 60 is inserted through retainer block 26 into die shoe 58 (see FIG. 7). Multiple fasteners can be used to secure retainer block 26 to die shoe 58 as is necessary. Additionally, dowel pins (not shown) can be inserted into retainer block 26 for insuring proper alignment with die shoe 58. Once retainer block 26 and punch retainers 22 are secured to die shoe 58, a punch 28 can be inserted in aperture 32 and punch retainer 22. The die is then ready to be used to punch holes in the product being manufactured. Because the punch retainers 22 have a substantially smaller body than the prior art punch retainers, they can be much more closely positioned than was previously possible. Punch retainer system 20 can therefore be used to create hole patterns that previously required specially manufactured tools that were typically not available for most tool and die shops.

While the present invention has been described in terms of the preferred embodiments discussed in the above specification, it will be understood by one skilled in the art that the present invention is not limited to these particular preferred embodiments, but includes any and all such modifications that are within the spirit and scope of the present invention as defined in the appended claims.

The embodiments of the present invention in which an exclusive property or privilege is claimed are defined as follows:

1. A punch retainer, comprising:

a one-piece body having a top and a bottom face;

an aperture defined in said body for receiving a punch, said aperture extending vertically from said top face to said bottom face of said body, said aperture adapted to retain said punch in a position in which said punch extends out of the bottom face of said body; and a peripheral surface on said body, at least a portion of said peripheral surface being tapered inwardly toward said aperture from said top face to said bottom face, said peripheral surface for immovably supporting said punch retainer in a retainer block, said peripheral surface defining a non-circular shape for at least one horizontal cross-section through said body between said top and bottom face.

2. The punch retainer of claim 1 further including a lock selectively insertable into said aperture and adapted to selectively lock a punch in said aperture.

3. The punch retainer of claim 1 wherein said body does not include any screw holes for securing said punch retainer to a die shoe.

4. The punch retainer of claim 1 wherein said peripheral surface is tapered radially inward toward said aperture.

5. The punch retainer of claim 1 further including a retainer block that defines a recess configured to snugly receive said punch retainer.

6. The punch retainer of claim 5 wherein said retainer block includes a plurality of screw holes adapted to each receive a screw for securing said punch retainer and said retainer block to a die shoe.

7. A punch retainer, comprising:

a one-piece body having a top and a bottom face, said body including no fastener holes for receiving a fastener to secure said body to a die shoe;

an aperture defined in said body for receiving a punch that extends out of the bottom face of said body, said aperture extending vertically from said top face to said bottom face of said body and defining a vertical axis at a center of said aperture;

a peripheral surface defined on said body, said peripheral surface defining a non-circular shape for at least first and second horizontal cross-sections through said body between said top and said bottom face, said first horizontal cross-section extending outwardly from said vertical axis in at least one horizontal direction a greater distance than said second horizontal cross-section extends outwardly from said vertical axis in said horizontal direction, said first horizontal cross-section being defined above said second horizontal cross-section; and a lock enclosed by said body, said lock selectively retaining the punch in said aperture.

8. The punch retainer of claim 7 wherein at least a portion of said peripheral surface tapers radially about at least a portion of said vertical axis.

9. The punch retainer of claim 8 wherein said peripheral surface is tapered inwardly at an angle less than twenty degrees.

10. The punch retainer of claim 8 wherein said peripheral surface is tapered inwardly at an angle less tan twenty degrees.

11. A punch retainer system, comprising:

at least one insertable punch retainer having a body that defines an aperture for receiving a punch having at least one cutting edge; and a retainer block having at least one recess configured to snugly receive said insertable punch retainer, said recess including an immobile sloped surface integral with said retainer block said sloped surface preventing said insertable punch retainer from being withdrawn from said recess in a direction toward the cutting edge of the punch, said retainer block including at least one hole for receiving a fastener that secures said retainer block to a die shoe.

12. The punch retainer system of claim 11 further including a plurality of insertable punch retainers and a plurality of recesses defined in said retainer block.

13. The punch retainer system of claim 11 further including a backing plate attached to said retainer block and said insertable punch retainer.

14. The punch retainer system of claim 11 wherein said retainer block further includes at least one dowel pin for aligning said retainer block with a die shoe.

15. The punch retainers system of claim 11 wherein said sloped surface slopes radially inward toward said aperture.

16. The punch retainer system of claim 11 wherein each said insertable punch retainer includes a lock that selectively retains the punch in said aperture.

17. The punch retainer system of claim 16 wherein said lock includes a ball and a spring, said spring biasing said ball at least partially into said aperture.

18. A punch retainer system, comprising:

at least one insertable punch retainer having a body that defines an aperture for receiving a punch, said at least one insertable punch retainer including a top face, a bottom face, and a peripheral surface, said peripheral surface being tapered inwardly from said top face to said bottom face;

a retainer block having at least one recess configured to snugly receive said insertable punch retainer, said recess including an immobile sloped surface integral with said retainer block, said sloped surface preventing said insertable punch retainer from being withdrawn from said recess in at least one direction, said retainer block including at least one hole for receiving a fastener that secures said retainer block to a die shoe.

19. The punch retainer system of claim 18 further including a plurality of insertable punch retainers and a plurality of recesses defined in said retainer block.

20. A punch retainer, comprising:

a one-piece body having a top and a bottom face;

an aperture defined in said body for receiving a punch, said aperture extending vertically from said top face to said bottom face of said body;

a peripheral surface on said body, at least a portion of said peripheral surface being tapered inwardly toward said aperture from said top face to said bottom face, said peripheral surface for immovably supporting said punch retainer in a retainer block, said peripheral surface defining a non-circular shape for at least one horizontal cross-section through said body between said top and bottom face; and a lock selectively insertable into said aperture and adapted to selectively lock a punch in said aperture, said lock including a ball and a spring, said spring positioned to bias said ball at least partially into said aperture.

* * * * *